US006229107B1

(12) United States Patent
Flint et al.

(10) Patent No.: US 6,229,107 B1
(45) **Date of Patent: *May 8, 2001**

(54) SAFETY ELECTRICAL RECEPTACLE

(76) Inventors: Steven G Flint, 2151 Hastings Ct.; Thomas William Shelton, 2154 Hasting Ct., both of Santa Rosa, CA (US) 95405-8377

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/368,922

(22) Filed: Aug. 6, 1999

(51) Int. Cl.[7] ..... H01R 29/00; H01R 33/96
(52) U.S. Cl. ..... 200/51.09; 439/188
(58) Field of Search ..... 200/51 R, 51.02, 200/51.03, 51.04, 51.07–51.09, 51.11, 51.12, 50.2, 50.31, 310, 317; 439/188, 259, 261

(56) References Cited

U.S. PATENT DOCUMENTS

| | | | | |
|---|---|---|---|---|
| 2,189,676 | * | 2/1940 | Pfohl | 240/2 |
| 4,271,337 | * | 6/1981 | Barkas | 200/51.09 |
| 5,112,237 | * | 5/1992 | Yang | 439/188 |
| 5,186,539 | * | 2/1993 | Comerci et al. | 439/188 |
| 5,320,545 | * | 6/1994 | Brothers | 439/188 |
| 5,374,199 | * | 12/1994 | Chung | 439/188 |
| 5,484,299 | * | 1/1996 | Schlessinger | 439/188 |
| 5,865,635 | * | 2/1999 | Hsiang et al. | 439/188 |
| 5,928,019 | * | 7/1999 | Chen et al. | 439/188 |
| 6,111,210 | * | 8/2000 | Allison | 200/51.09 |

* cited by examiner

*Primary Examiner*—Michael Friedhofer

(57) ABSTRACT

A safety electrical receptacle is disclosed which eliminates the danger of accidental shock due to inserting a foreign object into the socket of the described device. The safety electrical receptacle body includes cavities and support structures for positioning rotating cams, fixed electrical sockets with integral electrical contacts and movable resilient spring loaded electrical busses with integral electrical contacts. The contacts remain open and electrically inactive when the receptacle is in the normal unused state with the resilient spring bus displacing the rear cam lobe and positioning the front cam lobe directly into the socket opening. When a plug or other object is inserted into the socket it displaces the front cam lobe and the rear cam lobe moves against the spring loaded electrical bus and closes the contact on the opposite socket. Conversely, when the mating connector plug is removed from the socket the spring loaded electrical bus opens the contacts, repositions the cam in the socket opening and the socket is electrically inactive. The described invention is incorporated within the dimensions of a standard type electrical outlet receptacle and renders the outlet safe, in that no voltage is present at the socket of the receptacle unless the proper mating connector plug is fully inserted into each socket. The cover plate of the safety receptacle has visible markings and power indicator lamps to indicate that it is a safety receptacle. The disclosed safety electrical outlet is designed to mate with and be effective with any standard mating connector, whether equipped with a grounding prong or not. The described invention is designed to be manufactured within currently accepted and approved standard dimensions for electrical outlets and electrical enclosures.

3 Claims, 3 Drawing Sheets

SAFETY ELECTRICAL RECEPTACLE

APPLICATION CONTROL NUMBER

09/368-922

REFERENCES CITED

U.S. Pat. No. 4,271,337 June 1981 Barkas
U.S. Pat. No. 5,112,237 May 1992 Yang
U.S. Pat. No. 5,186,639 February 1993 Comerci et al
U.S. Pat. No. 5,320,545 June 1994 Brothers
U.S. Pat. No. 5,374,119 December 1994 Chung
U.S. Pat. No. 5,865,635 February 1999 Hsiang
U.S. Pat. No. 5,928,019 July 1999 Chen

BACKGROUND OF THE INVENTION

The standard household or commercial electrical receptacle can present a serious shock hazard when the receptacle is open and accessible to children. The electrical contacts within the receptacle can be easily accessed through openings in the cover plate by means of inserting any electrically conductive probe and result in serious shock and/or disfigurement. Numerous efforts to provide a safe electrical outlet have been attempted with varying results as demonstrated in numerous United States Patents. A review of these patents reveals that the solutions arrived at are either extremely complicated or do not provide adequately safe or reliable solutions. In addition, these designs are not recognizable as a safety receptacle without an electrical test to determine the characteristic of the device. It is extremely important that the device not only solve the safety problem but be easily identified as a safety receptacle. In order for the device to be useful and accepted, the device must be reliable, interchangeable with those receptacles currently in use, and it must be manufactured at a reasonable cost in order to reach those who would most likely to use the invention. In the teachings of Chen, Hsiang, Barkas, Yang, Chung and others, we have found mechanisms, which fail to comply with existing electrical dimensional standards, involve modifications to external elements to operate correctly or, are of such complexity or unique component arrangement as to be uneconomical to manufacture and therefore unlikely to be utilized to attain the safety goals envisioned by the proponents. Devices which incorporate sliding actuators offer considerable potential friction resistance and will tend to wear, creating operational difficulty. In Yang's teaching, the illuminated indicator device is described as a Light Emitting Diode (LED) which has specific electrical demands not met in standard alternating current circuits. Also, the plunger design in Yang's teaching could be unintentionally defeated should a plug with a recessed face or an extra insulated cover be used in conjunction with this invention. The invention described within requires no modification of mating devices, uses and maintains adopted standards for electrical receptacle dimensions and can be manufactured at a cost comparable to most modern electrical outlet products. To address ease of operation and reliability, the described device uses a molded cam, positioned in its cavity in the safety receptacle body, which rotates about a fixed axis providing continuous operation with little friction and minimal wear regardless of repeated use. The described invention provides the required measure of safety, simple recognition of the device and a warning to alert the user to any failure of the device.

SUMMARY OF THE INVENTION

The purpose of this invention is to prevent accidental electrical shock and injury by eliminating the voltage potential normally present in unprotected electrical receptacle sockets unless a proper mating plug is fully inserted into the receptacle. It is also the purpose of this invention to prevent accidental electrical shock and injury to children and others by intentional or inadvertent insertion of an electrical conducting material into the plug socket of an electrical outlet by eliminating the voltage potential normally present in the electrical receptacle until a proper mating plug is fully inserted into the receptacle. It is also the purpose of this invention to minimize the potential of electrical shock by inadvertent contact with the energized plug prongs when partially inserted into the receptacle and in contact with the energized contact therein by eliminating the voltage potential normally present in the electrical receptacle until the mating plug is fully inserted into the receptacle and removing the voltage from the plug prongs prior to the complete removal of the plug prong from the outlet socket. It is also the purpose of this invention to reduce the occurrence of arcing between the prong of the connector plug and the socket of the electrical outlet during the insertion and removal of the plug by eliminating the voltage potential normally present in the electrical receptacle until the mating plug is fully inserted into the receptacle and removing the voltage prior to the complete removal of the plug prong from the outlet socket. It is also the purpose of this invention to provide a clear visible means of identification to easily determine the device is a safety type receptacle by including a unique marking and an illuminated device located on the face of each receptacle. These markings and illuminated devices may be placed between the insertion points for the receptacle sockets, the area surrounding each of the insertion points for the receptacle sockets, or otherwise located to be easily seen and recognizable. The invention encompasses standard wall socket electrical outlet receptacles of the type found in residential, retail, commercial and industrial installations and electrical sockets used in various portable electrical extension cords and apparatus utilizing a socket receptacle configuration for a blade or pin type plug without a safeguard or other device to prevent the intentional or inadvertent insertion of a conducting device into the energized socket thereby creating a potential electric shock hazard to children and others. The invention can be incorporated within a typical electrical outlet receptacle assembly which includes a thermoplastic or other non-conducting cover and base assembly between which are mounted the "line" and "neutral" contact terminals, "ground" wire assembly, switch contacts and contact actuation means with all components electrically isolated from one another. In the invention's normal state, when the receptacle is correctly installed and wired according to design specification and it is not in use, (no mating plug inserted) there is no voltage potential from the "line" side socket to "ground" or to the "neutral" or "ground" sockets of the receptacle. Therefore, should any object capable of electrical conduction be inserted into the receptacle sockets no voltage potential will be present and no shock hazard will be likely. When the correct mating connector plug, with or without grounding pin, is inserted into the receptacle sockets, it contacts a cam which positions electrical contacts within the outlet receptacle assembly closed and energizes the opposite socket. When the mating connector plug is removed, the electrical contacts within the outlet receptacle are moved to the open position by a resilient spring bus mechanism which repositions the cam in the opposite socket, rendering the outlet safe in that the sockets are electrically inactive.

The present invention can be best understood through the following description and accompanying drawings, wherein:

DETAILED DESCRIPTION OF THE INVENTION

Figure 1:
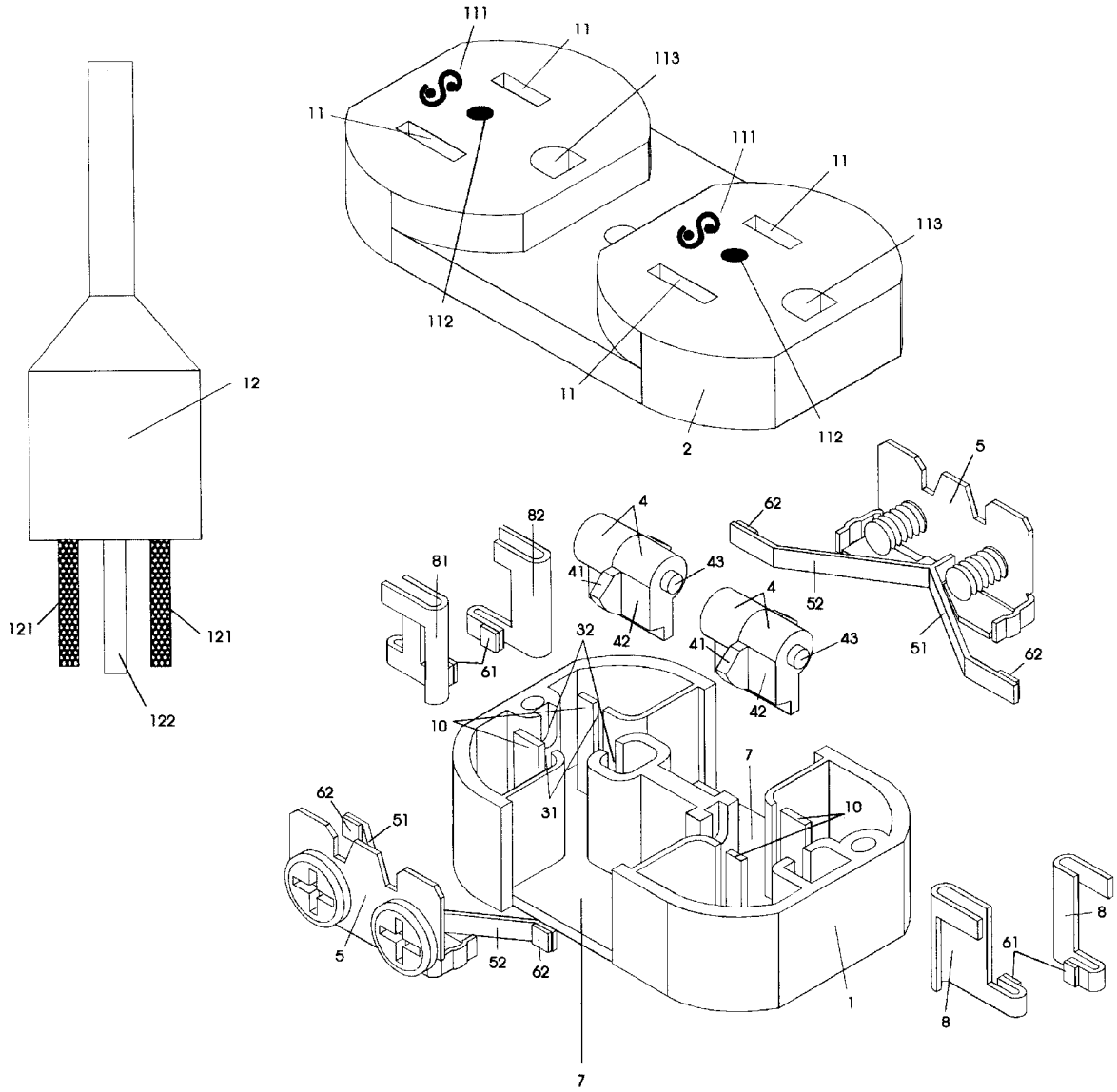
FIG. 1. is a perspective exploded view of the present invention.

Please refer to FIG. 1. In FIG. 1, the body 1 of the safety receptacle of the present invention contains a cam cavity 3, cam bearing point 32 and slot 31 which positions and fixes the motion of cam 4 as shown in FIG. 1. Also contained within the body 1 of the safety receptacle is a resilient spring electrical bus assembly 5, securely mounted in its own interlocking slot and cavity 7 arrangement in the body 1 of the safety socket and fixed in position by the safety receptacle cover plate 2. The circuitry equivalent to power or neutral resilient spring connections 51 or 52 are an integral part of the electrical bus assembly 5. The electrical sockets 81 and 82, formed from a resilient conductive material with an electrical contacts 61 permanently affixed, are mounted on a non-conductive wall structure 10 within the safety socket body and aligned with the safety receptacle cover plate 2 containing the mating plug insertion holes 11, the safety receptacle identifier 111 and power indicator lamp 112, which also serves to hold the sockets 81 and 82 in position within the safety socket body 1. The cam pin 43 connects and aligns each side of the cam 4 and is positioned in the cam bearing point 32 which locates the cam 4 and provides the pivot angle point for the cam. The cam is further locked in its position by the safety receptacle cover plate 2. The cam 4 is normally positioned with one contact element lobe 41 of the cam intruding into the opening in socket 81 and 82, and the opposite contact lobe 42 to be in direct contact with a corresponding resilient spring, 51 or 52 of electrical bus assembly 5 with permanently affixed electrical contacts 62.

Figure 2:
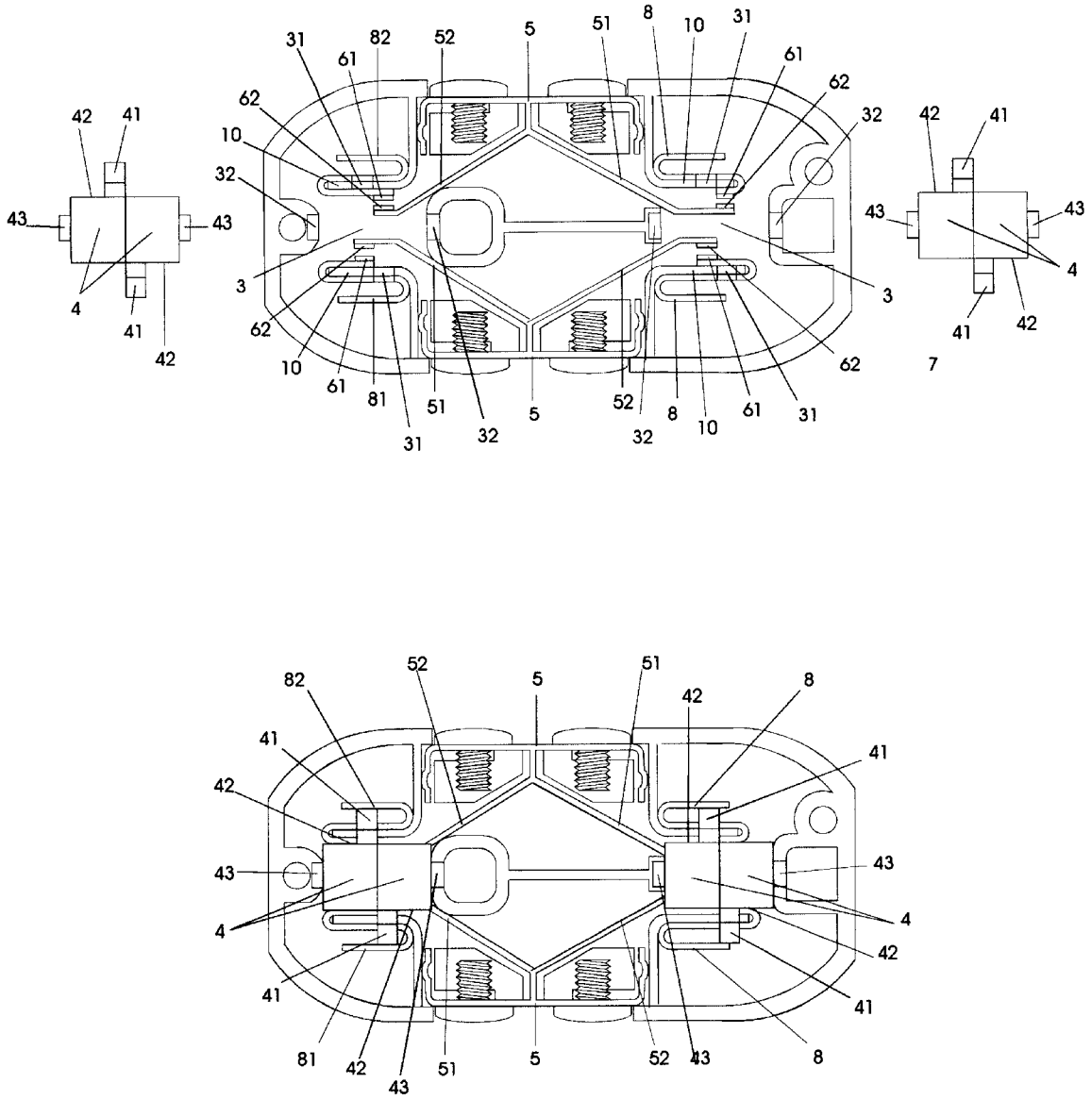
FIG. 2. are the assembled views of the present invention.

Please refer to FIG. 2. In FIG. 2, the first view, the cover plate 2 is removed from the body 1 of the described invention and cams 4 are removed to view underlying components; in the second view, cams 4 are installed to demonstrate the complete internal assembly of the invention.

Figure 3:
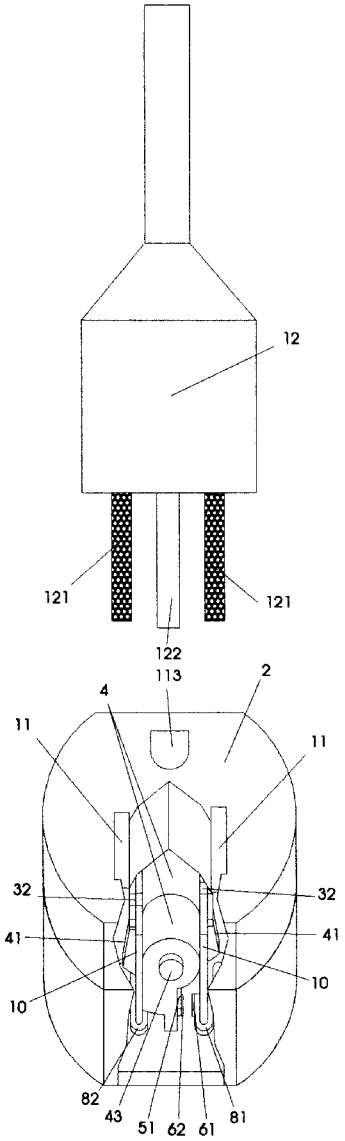
FIG. 3. is a sectional view showing a plug about to be inserted into the safety receptacle.

Please refer to FIG. 3. In FIG. 3 the normal state with no plug or other object inserted into the sockets 81 or 82, through the insertion hole 11, the electrical contacts 61 on sockets 81 and 82 and contact 62 on corresponding resilient spring, 51 or 52 remain apart and non-conducting and the cam 4 remains in direct contact with corresponding resilient spring electrical bus assembly 51 and 52 and inhibiting the passageway of the opening in sockets 81 and 82. No current will be available on either of sockets 81 or 82 and power indicator lamp 112 will not be illuminated.

Figure 4:
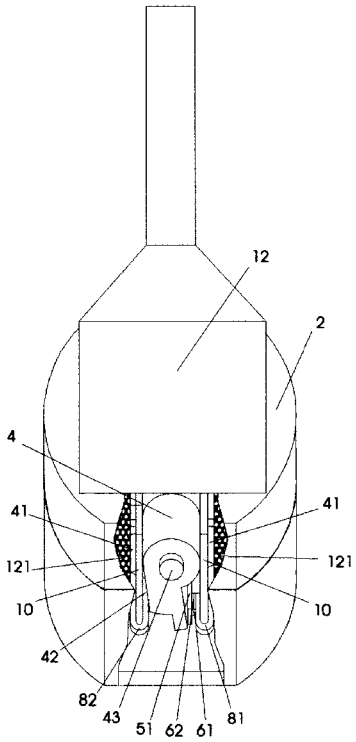
FIG. 4. is a sectional view showing a plug inserted into the safety receptacle.

Please refer to FIG. 4. In FIG. 4 when a proper mating plug 12 with two male conductive prongs 121 of appropriate dimension, with or without a ground prong 122 inserted into cover plate hole 113, is inserted through cover plate holes 11 and into the electrical sockets 81 and 82, the prongs 121 contact the lobes 41 of cams 4 and the subsequent rotational movement of the cams 4 around the axis of cam pin 43 in cam bearing point 32 causes the lobes 42 to move against the resilient spring, 51 and 52 of electrical busses 5 which closes contacts 61 onto contacts 62 on the sockets 81 and 82 and allows current to flow through electrical bus assembly 5 to the sockets 81 and 82 on each opposite prong of the safety receptacle and illuminate the power indicator lamp 112. Thus, no electrical current is available on sockets 81 and 82 until a proper mating plug is inserted into the opposite side sockets.

Figure 5:
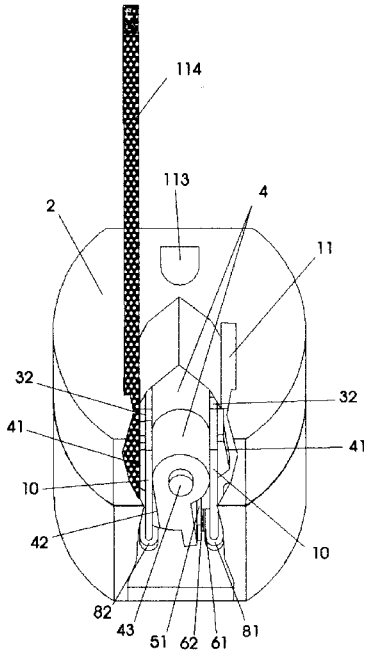
FIG. 5. demonstrates a foreign object inserted into the insertion hole and socket of the safety receptacle.

Please refer to FIG. 5. In FIG. 5 it is shown that if a conductive foreign object or probe 114 is inserted into either insertion hole 11 and further into either sockets 81 and 82, the object 114 would contact the lobe 41 of cam 4 and the subsequent rotational movement around the axis of cam pin 43 in cam bearing point 32 causes and cause lobe 42 to move against the resilient spring, 51 or 52 of electrical bus 5 closing contact 61 onto contact 62 on the sockets 81 or 82 on the opposite side of the plug's circuit and although the opposite socket 81 or 82 would be energized no voltage would be present in the socket 81 or 82, where the foreign object 114 has been inserted and no electrical hazard would exist. In the event that of a failure of a safety receptacle component mechanism were to occur and voltage remained on the power side sockets 81 and 82, then the power indicator lamp 112 would be illuminated to warn of a potential shock hazard.

It is to be understood that the above description and drawings are only used for illustrating one embodiment of the present invention, not intended to limit the scope thereof. Any variation and derivation from the above description and drawings should be included in the scope of the present invention.

What is claimed is:

1. A safety electrical outlet receptacle comprising:

(a.) a molded body of non-conductive, electrically insulating material incorporating an electrically conducting neutral socket, an electrically conducting voltage socket, cam mounting points and a cover plate of non-conductive, electrically insulating material with corresponding slots mating with the said neutral socket and said voltage socket in the molded body which receive an electrical plug with two mating prongs;

(b.) resilient spring electrical bus assemblies with integral electrical contacts;

(c.) two independent cams, located on a single rotational axis within said molded body, with a contact element lobe of a first said cams positioned in a slot within said voltage socket and in the path of one of said mating prongs by said resilient spring electrical bus assemblies; and, a contact element lobe of the second of said cams, positioned in said neutral socket and in the path of the other of said mating prongs by said resilient spring electrical bus assemblies and both of said cams are secured in place by said molded cover plate;

(d.) normally open, electrical switch contacts mounted on said neutral socket, said voltage socket and on said resilient spring electrical bus assemblies;

(e.) a first of said normally open contacts being activated by said first cam when a connector with said mating prongs is inserted into said voltage socket and displaces said corresponding contact element lobe and a resultant rotation of said first cam causes said first cam to displace a corresponding one of said resilient spring electrical bus assemblies which, in turn, closes the corresponding contacts on said neutral socket causing said neutral socket to be electrically active and supply current to said corresponding mating plug prong;

(f.) a second of said normally open contacts being activated by said second cam when a connector with said mating prongs is inserted into said neutral socket and displaces said corresponding contact element lobe and a resultant rotation of said second cam causes said second cam to displace another of said resilient spring electrical bus assemblies which, in turn, closes the corresponding contacts on said voltage socket causing said voltage socket to be electrically active and supply current to said corresponding mating plug prong;

(g.) when said prongs are removed from said neutral socket and said voltage socket, said resilient spring electrical bus assemblies will move said electrical contacts to the open position and position said contact element lobe of said first cam in said voltage socket and the contact element lobe of said second cam positioned in said neutral socket into the path of said mating plug prongs.

2. A safety electrical outlet receptacle as described in claim 1 above comprising:

(a.) a visible illuminated indicator mounted in said cover plate and electrically connected to said neutral socket and said voltage socket which illuminates when the sockets are electrically active.

3. A safety electrical outlet receptacle as described in claim 1 above comprising (a.) a clearly visible permanent marking prominently displayed on said molded cover to indicate that the receptacle is used for safety.

* * * * *